United States Patent [19]

Altman

[11] 4,058,066

[45] Nov. 15, 1977

[54] ADJUSTABLE TABLE

[76] Inventor: Nicholas M. Altman, 10 Mountain Way South, West Orange, N.J. 07052

[21] Appl. No.: 701,289

[22] Filed: June 30, 1976

[51] Int. Cl.[2] ..... A47B 27/14

[52] U.S. Cl. ..... 108/9; 108/10

[58] Field of Search ..... 108/4, 6, 8, 9, 10

[56] References Cited

U.S. PATENT DOCUMENTS

| | | | |
|---|---|---|---|
| 527,017 | 10/1894 | Fry | 108/9 |
| 677,216 | 6/1901 | Huebner | 108/4 |
| 874,052 | 12/1907 | Contwell | 108/4 |
| 2,265,105 | 12/1941 | Farrington | 108/4 |

*Primary Examiner*—Marion Parsons, Jr.
*Assistant Examiner*—William E. Lyddane
*Attorney, Agent, or Firm*—Norman N. Popper

[57] ABSTRACT

An adjustable table wherein front and rear legs open to provide a rigid support for a pair of pivotably mounted upper legs, to which a table is pivotably attached; slotted arms adjust the position of the upper legs with respect to the front legs; and slotted arms adjust the position of the table with respect to the upper legs; a bar spaces the front legs apart and a smaller space the upper legs aparts; each bar encloses a rod with a threaded end for a thumb nut to cinch a slotted arm in a preselected position for holding the table.

1 Claim, 10 Drawing Figures

FIG. 3
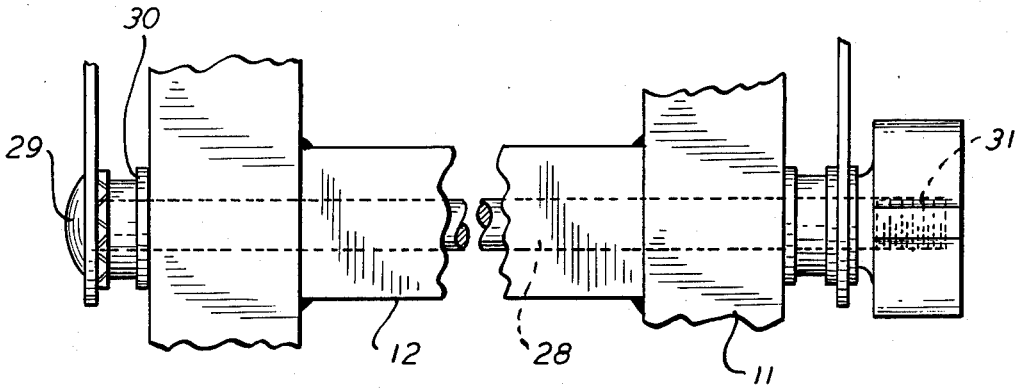
FIG. 4
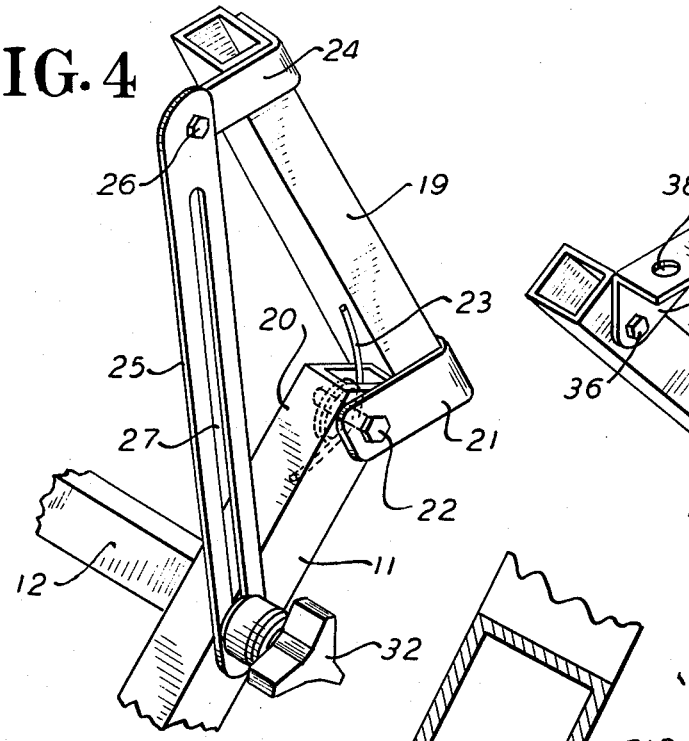
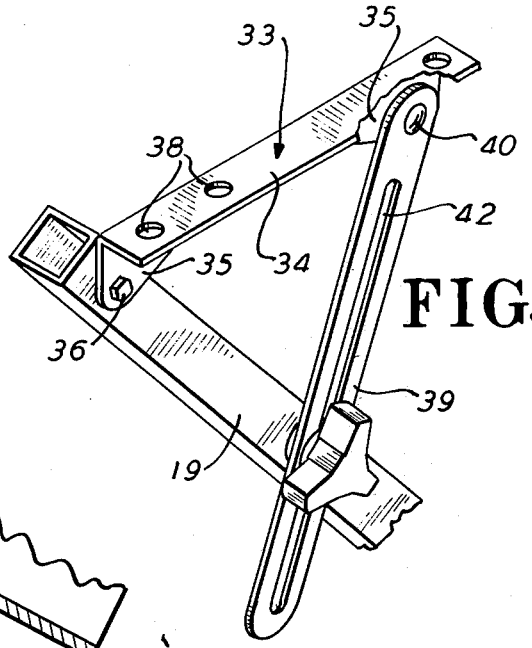
FIG. 5
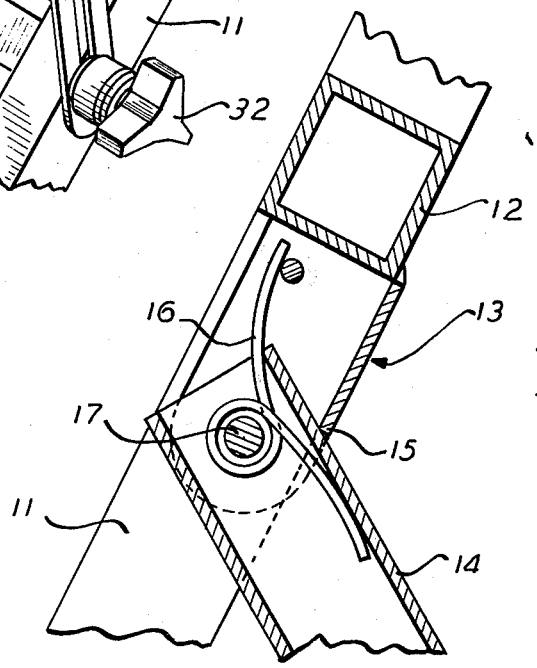
FIG. 6

ADJUSTABLE TABLE

BACKGROUND OF INVENTION

1. Field of Invention

This invention relates generally to adjustable tables, and specifically to such tables rigidly adjustable to a wide variety of attitudes by reason of the pivotable adjustment of an upper leg and a table-top pivotably attached to the upper leg.

2. Prior Art

Adjustable tables find numerous applications for use such as for artist easels, as drafting tables, in navigation to hold large maps, in business to hold work programs, work assignments, plans for building apparatus. In these applications versatility of height, angular adjustment, comfort and convenience of the user, freedom from jamming, sturdiness, rigidity, costliness, and durability are all important factors. These attributes are not always attained.

SUMMARY OF INVENTION

It has been found that the desirable attributes referred to may be attained in an adjustable table wherein a pair of front legs are pivotably attached to a pair of rear legs and the front legs are rigidly attached to each other by a cross bar, while the rear legs are pivotably attached to mounting brackets attached to the bar. A pair of upper legs are pivotably attached to the upper end of the front legs, and a table top pivotably attached to the upper legs. A bar serves the upper legs together. Rods through both bars mount slotted adjustment rods that can be fixed at preselected positions.

DRAWINGS

Rigidity, versatile adjustment, sturdiness and the other advantages may be attained by the device shown by way of illustration in the drawings in which:

FIG. 3 is a longitudinal view of spacer bar connecting the front legs, showing the road enclosed therein and the slotted control arms secured thereto;

FIG. 4 is a perspective partial view of a front leg connected to an upper leg, with the slotted control arm adjusting the positions of the legs;

FIG. 5 is a perspective partial view of an upper leg connected to a table bracket, with a slotted control arm adjusting their respective positions;

FIG. 6 is a partial vertical sectional view of the front and rear legs pivotably connected together, and the mounting bracket restraining the extension of the rear leg.

PREFERRED EMBODIMENT

Figure 8A:
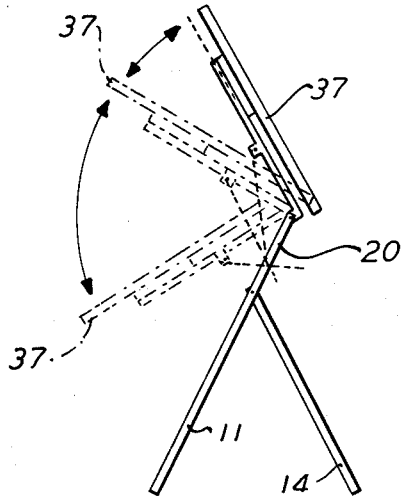
FIGS. 8A, 8B and 8C are side elevational views of the table showing the numerous positions that may be assigned to the table top for various different uses, to suit the convenience and purpose of the user.
Figure 8B:
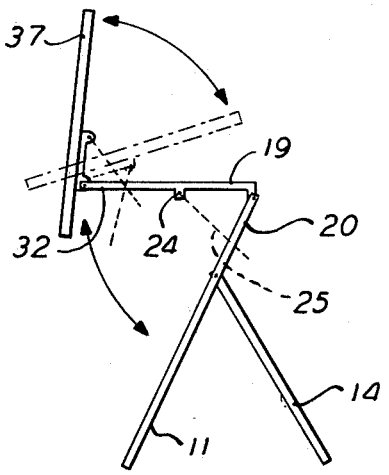
Figure 8C:
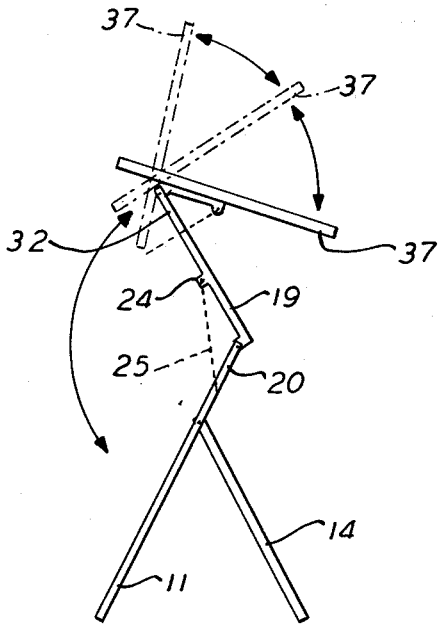

The adjustable table provides a pair of front legs 11 which are rigidly attached together by a first transverse bar 12 secured at opposite ends to the front legs 11 near the upper end thereof in such a manner as to hold the legs in spaced, generally parallel relation to each other. At the points where the bar 12 is engaged with the front legs 11, mounting brackets 13 are attached, in some suitable manner such as welding, to the bar 12. A pair of rear legs 14 are pivotably attached at their upper ends to the mounting brackets 13, so that they may fold to lie in the same plane with and between the front legs 11, or be pivoted until they are disposed at an angle to the front legs 11 as indicated in FIGS. 8A, 8B and 8C, and in this way provide a sturdy support for the remaining assembly. The mounting brackets 13 have a shoulder 15 which serves to limit the pivotable extension of the rear legs 14 with respect to the front legs 11, to an angular disposition to the front legs 11 of approximately 45°; this has been found to supply a suitably firm base, resistant to tipping of the table. A spring 16 is carried by the pivot pair 17, and normally urges the front legs 11 and the rear legs 14 to extended position. A second transverse bar 18 is rigidly attached at opposite ends to the rear legs 14 to hold them in general parallelism, and in spaced, fixed relation to each other.

A pair of the upper legs 19 are pivotably attached at one end of the upper end 20 of the front legs 11. Attachment is arranged by securing generally perpendicular arms 21 to one end of each of the upper legs and then pass bolts 22 through the arms and the upper end 20 so that the upper legs 19 are freely pivotable with respect to the front leg 11. Spring 23 is carried by the bolt 22 and engage the front legs 11 and the upper legs 19 to normally urge the legs 11, 19 to assume a somewhat oblique angle to each other.

The upper legs 19 may be secured in selected angular relation to the front legs by the following assembly. A pair of control arm brackets 24 are attached to each of the upper legs at a generally middle portion of the upper legs 19. A pair of control arms 25 are each pivotably attached to the control arm brackets 24, by bolts 26. The control arms 25 are provided with logitudinal, internal slots 27. A first rod 28 is passed through the first transverse bar 12. There is a head or enlargement 29 on one end of the rod 28. The head 29 is in the form of a carriage bolt and has a shank portion sufficiently wide to fit into the slot 27 in arm 25. A washer 30 in the rod 28 positions the arm 25. At the opposite end of the rod 28, there is a thread 31. The other control arm 25 of the pair is located with its slot 27 embracing the rod 28 and a thumb-nut 32 is engaged with the thread 31. When the nut 32 is tightened, the upper arms 19 may be fixed at a series of positions varying from the acute angle shown in FIG. 8B, to the oblique angle shown in FIG. 8C (with respect to the front legs 11).

At the other end 32 of the upper legs 19, a pair of table brackets 33 are pivotably attached at one end to the other end 32 of the upper legs 19. These table brackets 33 have a flat top position 34 (See Fig. 5) and a perpendicular flange 35. Pivotable attachment may be obtained by bolt or pin 36. A generally flat table 37 is attached to the flat top position 34 by screws or other means passed through the holes 38 in the table brackets.

Figure 1:
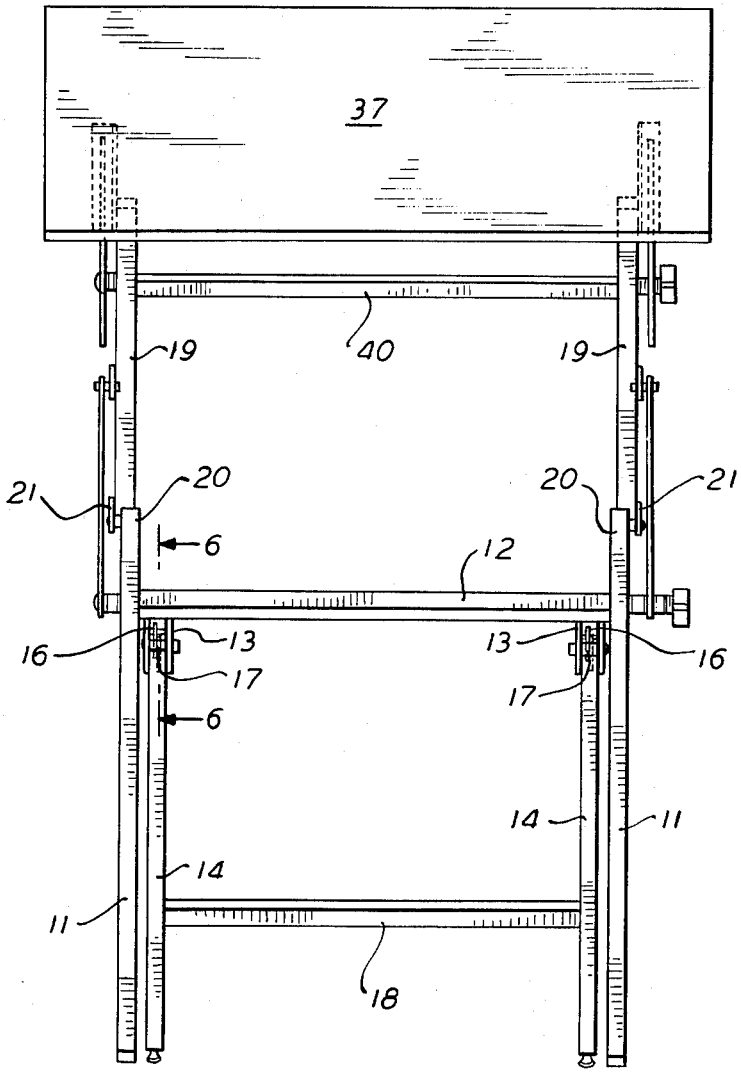
FIG. 1 is a front elevational view of the adjustable table.
Figure 2:
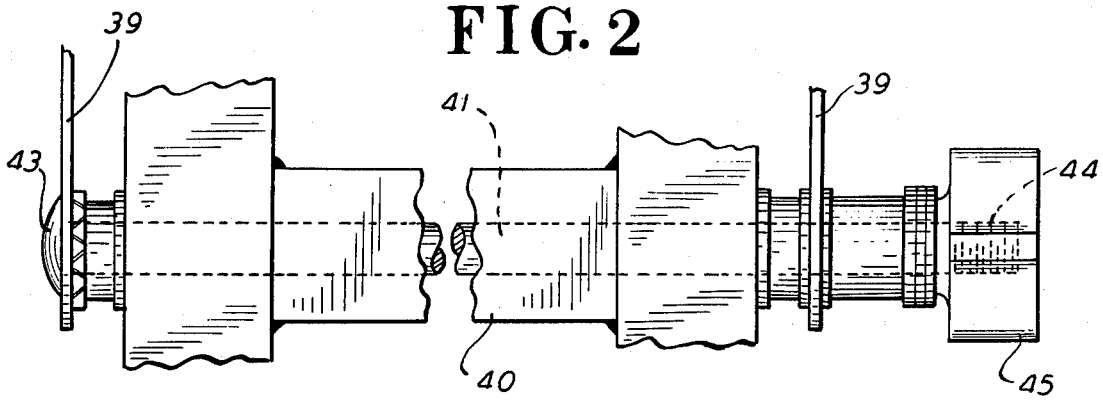
FIG. 2 is a longitudinal view of the spacer bar, connected to the upper legs showing the rod enclosed therein and the slotted control arms secured thereto.
Figure 7:
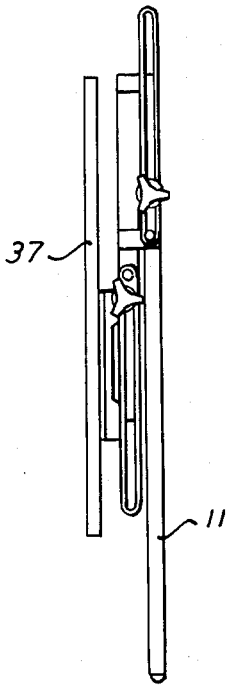
FIG. 7 is a side elevational view of the folded table.

Means to affirmatively position the table 37 is provided by supplying a second pair of slotted control arms 39 which are pivotably attached to the flange 35 by a bolt or pin 40. A spacer bar 40 is attached at each end of the upper legs 19, so as to maintain them in rigid parallelism. A rod 41 is passed through the bar 40. Slots 42 in the control arms 39 are carried on the ends of the rod 41. One end of the rod 41 is provided with a carriage bolt type enlargement 43 so that the rod 41 will not turn. The other end of the rod 41 is provided with a thread 44 and a thumb nut 45 is engaged. By sliding the slotted arms 39 on the rod, and tightening the nut 45, the table 37 may be adjusted to present its face at one side of the front and rear legs 11, 14 disposed at many angles as shown in FIG. 8B. Likewise, the table 37 may be adjusted at a great many positions facing the opposite direction, as shown in FIG. 8C. The versatility and ease of adjustment of the table is demonstrated in FIGS. 8A, 8B and 8C. Its ability to fold compactly is shown in FIG. 7.

What is claimed

1. An adjustable table comprising:

a. A pair of front legs, b. A first transverse bar rigidly attached at opposite ends to the front legs and holding them in spaced, generally parallel relation to each other, c. A pair of mounting brackets attached to the front legs, d. A pair of rear legs pivotably mounted on the mounting brackets, e. A second transverse bar rigidly attached at opposite ends to the rear legs and holding them in spaced, generally parallel relation to each other, f. The pair of rear legs pivotable to lie in the plane defined by the front legs, g. Portions of the mounting bracket positioned to stop the pivoting of the rear legs when they are extended from the front legs sufficiently to sustain the front legs in a standing position together with the rear legs, h. A pair of upper legs pivotably attached to the front legs at one end and pivotable around the front legs.

i. Control-arm brackets attached to each of the upper legs, j. Slotted control arms attached to each of the control-arm brackets, k. A first rod passed through the first transverse bar, having a head at one end engaged with a slot in one of the control arms and a thread on the other end of the rod, l. A nut on the thread at the other end of the rod which end is engaged with the slot in the other control arm, whereby the attitude of the upper leg may be affirmatively fixed in an elected position with respect to the front legs when the upper leg is pivoted on its front legs and the nut is tightened, m. A table, n. A pair of table brackets attached to the back of the table, o. The table brackets pivotably attached to the other end of the upper legs, p. A third transverse bar rigidly attached at opposite ends to the upper legs and holding them in spaced, generally parallel relation to each other, q. A second pair of slotted control arms attached to each of the table brackets, r. A second rod passed through the third transverse bar, having a head at one end engaged with a slot in one of the second control arms and a thread on the other end of the second rod, s. A nut on the thread at the other end of the second rod which end is engaged with the slot in the second control arm, whereby the attitude of the table with respect to the upper legs may be affirmatively fixed with respect to the upper legs when the table is pivoted as the nut on the second rod is tightened.

* * * * *